US008714668B2

(12) United States Patent
Cash et al.

(10) Patent No.: US 8,714,668 B2
(45) Date of Patent: May 6, 2014

(54) READY TO ASSEMBLY CABINET

(75) Inventors: Justin Cash, Burton, OH (US); Thomas H. Fenton, Beachwood, OH (US)

(73) Assignee: Masco Cabinetry LLC, Ann Arbor, MI (US)

( * ) Notice: Subject to any disclaimer, the term of this patent is extended or adjusted under 35 U.S.C. 154(b) by 1506 days.

(21) Appl. No.: 12/062,783

(22) Filed: Apr. 4, 2008

(65) Prior Publication Data

US 2009/0251035 A1 Oct. 8, 2009

(51) Int. Cl.
*A47G 29/00* (2006.01)

(52) U.S. Cl.
USPC ..... 312/265.5

(58) Field of Classification Search
USPC ..... 312/257.1, 263, 264, 265.5, 265.6, 107, 312/108
See application file for complete search history.

(56) References Cited

U.S. PATENT DOCUMENTS

| | | | | |
|---|---|---|---|---|
| 5,111,966 | A * | 5/1992 | Fridman | 222/1 |
| 5,662,399 | A * | 9/1997 | Henkel et al. | 312/258 |
| 6,009,816 | A * | 1/2000 | Wendel | 108/157.17 |
| 6,209,976 | B1 | 4/2001 | Shear | |
| 2002/0109442 | A1 * | 8/2002 | Hsu | 312/263 |
| 2004/0189160 | A1 * | 9/2004 | Wells et al. | 312/263 |
| 2006/0108899 | A1 * | 5/2006 | Jin | 312/257.1 |
| 2006/0279182 | A1 * | 12/2006 | Chi Ming | 312/219 |

* cited by examiner

*Primary Examiner* — Matthew Ing
(74) *Attorney, Agent, or Firm* — Carlson, Gaskey & Olds, P.C.

(57) ABSTRACT

A ready to assemble cabinet includes a first panel that has a first side that corresponds to a base panel and a second panel that has a second panel that corresponds to the second side of that base panel. Each of the first and second panels includes at least one dimension that is unique or different from a dimension on the other panel. These unique dimensions correspond with a specific side of the base panel to prevent incorrect assembly of the cabinet.

11 Claims, 4 Drawing Sheets

READY TO ASSEMBLY CABINET

BACKGROUND OF THE INVENTION

This invention generally relates to method of producing a ready to assembly cabinet. More particularly, this invention relates to a method of producing a cabinet that is ready to assembly and includes features that prevent incorrect assembly.

Many cabinet systems are available in prepackaged kits that include precut pieces and fasteners for assembly by a purchaser. Openings for the fasteners are often provided in specific locations corresponding to attachment points on other panels. The fasteners are typically provided in a separate container within the kit and assembled by the purchaser.

The panels that comprise the kit are typically fabricated using manufacturing techniques and machines to optimize efficiencies. Accordingly, panels are sometimes fabricated with identical holes or cut in an identical manner for multiple parts. Accordingly, similar panels are fabricating using common hole locations to speed manufacturing and reduce cost.

Disadvantageously, the same features that reduce manufacturing time and cost contribute to the likelihood of incorrect assembly by the purchaser. The satisfaction of a purchaser is of great importance and can greatly impact product success and profitability.

Accordingly, it is desirable to design a ready to assembly cabinet with features that substantially prevent the likelihood of incorrect assembly and that also reduces the overall assembly time required by an inexperienced assembler.

SUMMARY OF THE INVENTION

An example ready to assembly cabinet includes a first panel that defines a first side and a second panel that defines a second side. Each of the first and second panels includes a plurality of opening into which fasteners are inserted and a unique dimension and allows assembly of the cabinet in only one desired way.

The example ready to assemble cabinet includes the plurality of panels that each includes at least one dimension that is unique with respect to other panels forming the cabinet to assure proper assembly. The example kit includes a plurality of fasteners attached to the corresponding panels. At least a couple of the fasteners are spaced apart from each other at a specific distance that is unique for each panel. The specific and unique distances for each of the fasteners that correspond to each of the panels prevent incorrect assembly.

Accordingly, the features of the disclosed kit provide a ready to assemble cabinet that prevents incorrect assembly and reduces overall assembly time.

These and other features of the present invention can be best understood from the following specification and drawings, the following of which is a brief description.

DETAILED DESCRIPTION OF THE PREFERRED EMBODIMENT

Figure 1:
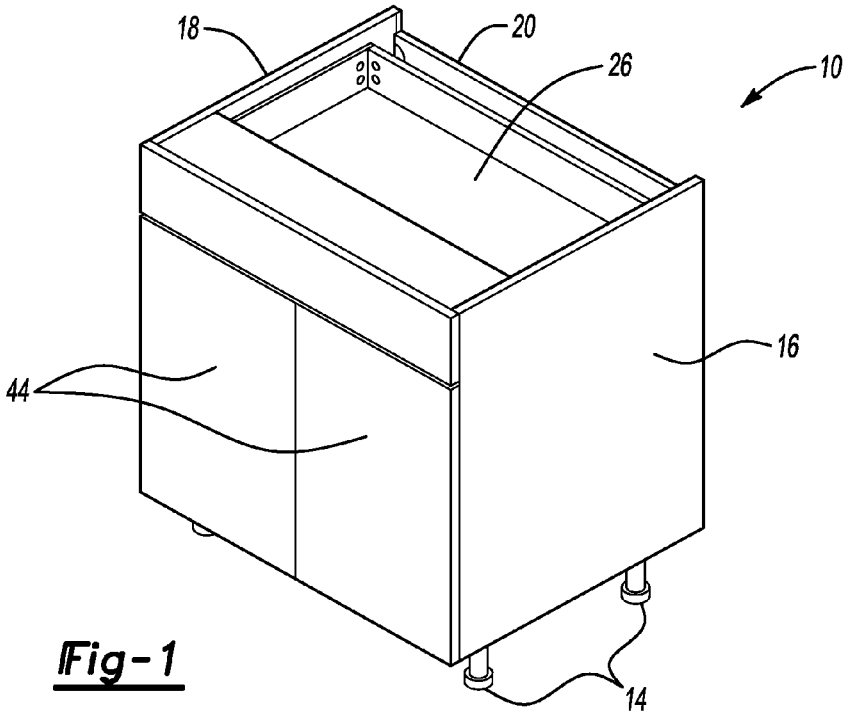
FIG. 1 is a perspective view of an assembled example cabinet.

Referring to FIG. 1, an example ready to assemble cabinet 10 includes a plurality of panels that are assembled by a consumer. The example cabinet 10 is shown in assembled form and includes a first side panel 16, a second side panel 18 and a back rail 20. Also shown is drawer 26 and doors 44. The example cabinet 10 includes leveling legs 14 that are assembled and have an adjustable height to level the cabinet 10 without the use of shims or other separate parts. The example cabinet 10 is provided in kit form with each of the panels being separated from each of the other panels. The kit form of the cabinet 10 reduces the amount of space required for storage prior to purchase and reduces the overall cost of the cabinet.

Figure 2:
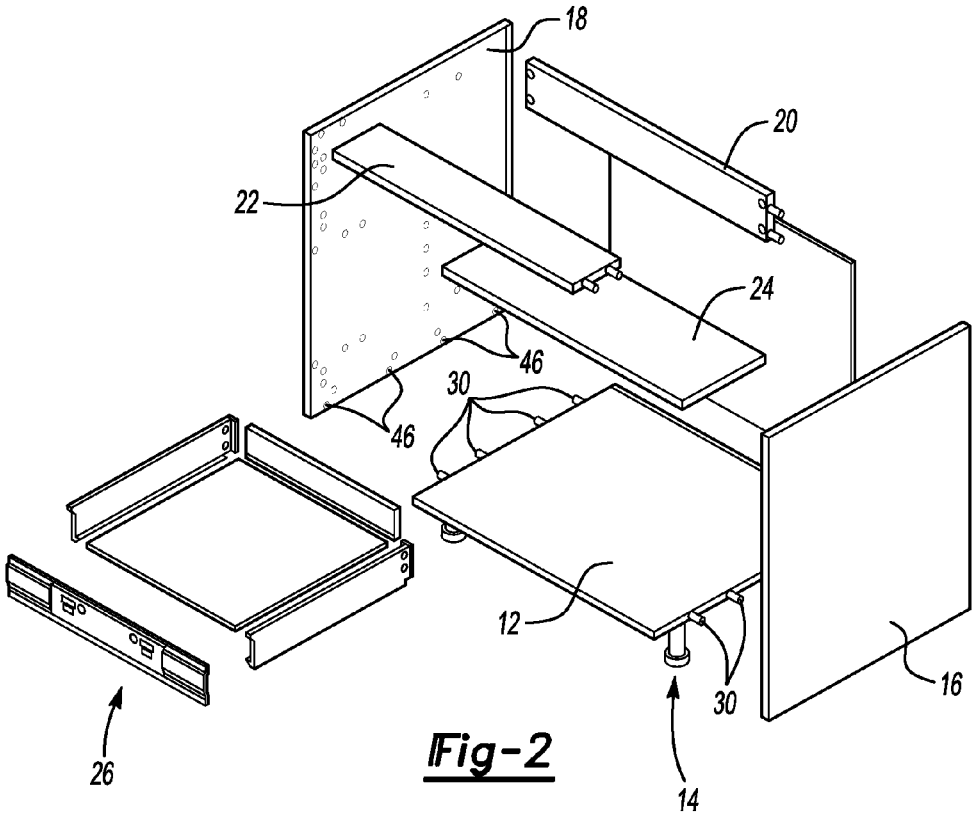
FIG. 2 is an exploded view of the example cabinet.

Referring to FIG. 2, the cabinet kit assembly 10 includes the first and second side panel 16, 18 and a bottom base 12. The side panels 16 and 18 are attached to the base 12. The base 12 is also the panel that receives the legs 14. The first and second panels 16, 18 are assembled on opposite sides of the base 12. Between the first panel 16 and the second panel 18 is a front rail 22 and a rear rail 20. Each of the panels 16, 18, 20, 12 includes fasteners 30. The fasteners 30 are pre-installed in the example kit 10. The pre-installation 10 of the fasteners 30 reduces overall assembly time and reduces possibility of assembly into incorrect openings by a consumer.

Figure 3:
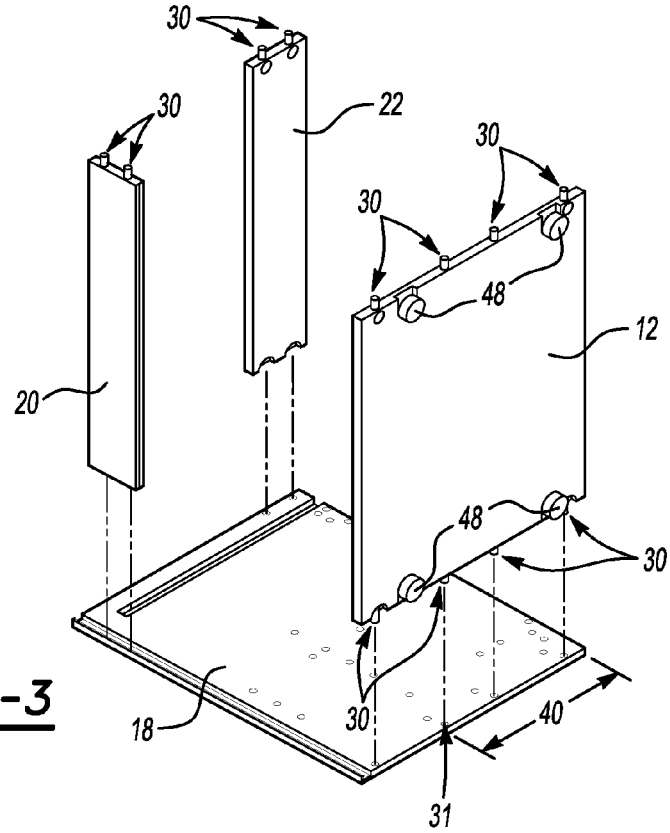
FIG. 3 is a perspective view of an initial assembly step for the example cabinet.

Referring to FIG. 3, the base 12 is shown in a perspective view looking up from the bottom. The base 12 is attached to the second side panel 18. The fasteners 30 are assembled within the base 12. The base 12 is then aligned with the second side panel 18. The fasteners 30 extend from the base 12 and correspond with the aligned holes within the side panel 18. Fasteners 30 are also installed in the rear panel 20 and the front rail 22 in openings aligned with corresponding holes within the second side panel 18.

As appreciated, even with the fasteners 30 pre-installed within the panels, the possibility exists for a consumer to incorrectly assemble a cabinet. This is often the case as some consumers will not accurately follow directions provided. For this reason, the example cabinet kit 10 includes hole spacing that is unique for each panel to allow assembly in only one manner. In the example shown, the opening 31 is disposed a distance 40 from a front portion from the panel 18. This dimension 40 is unique to the panel 18 and allows the base 12 to be assembled to the side panel 18 in only one manner. As appreciated, the opening or fasteners 30 within the base 12 correspond with the openings in the side panel 18. Thereby, a fastener corresponding to an opening that is a distance 40 from the front of the panel 18 is also disposed from the front of the panel 12 at a distance 40 such that it will provide the preferential alignment. However, if a fastener 30 is on an opposite panel 12, it would not be spaced apart the dimension 40 and therefore will not fit within the second panel 18.

Figure 4:
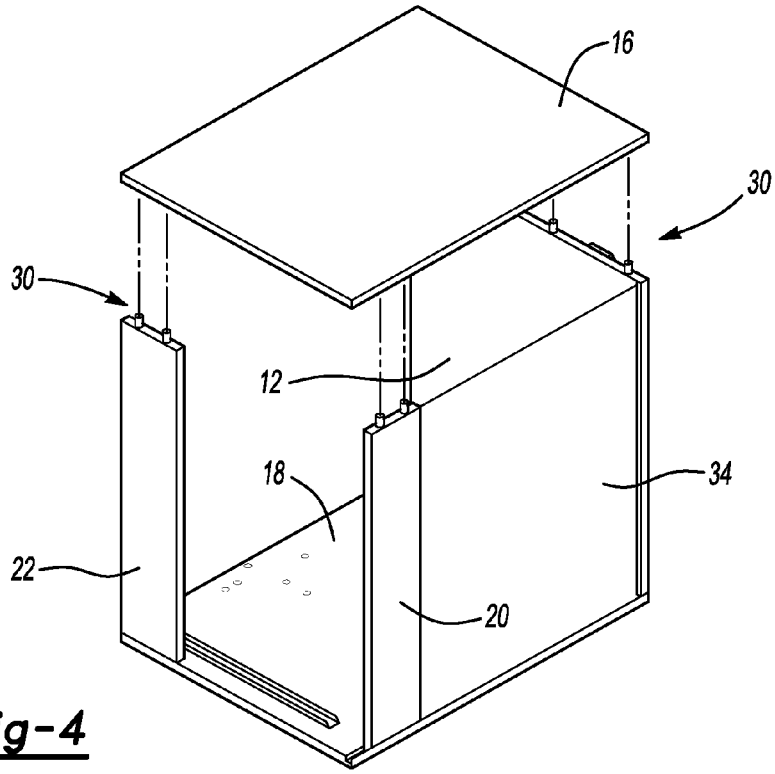
FIG. 4 is a perspective view of another assembly step of the example cabinet.

Referring to FIG. 4, another step in the cabinet assembly process is illustrated and in this step a rear panel 34 has been slid into a groove provided on the panel 18 and 20. The back panel 34 is assembled according to known techniques by being held within the groove provided on the panels 20 and 18. The first side panel 16 is then assembled to the base panel 12 and the front rail 22 and back rail 20. As appreciated, the fasteners 30 that are disposed within the rails 20, 22 and the base panel 12 extend into corresponding openings supplied in the first panel 16. The first panel 16 includes opening space to correspond with the only one side of the base 12. Thereby, the first panel is prevented from being assembled in a manner that is not desired.

Figure 5:
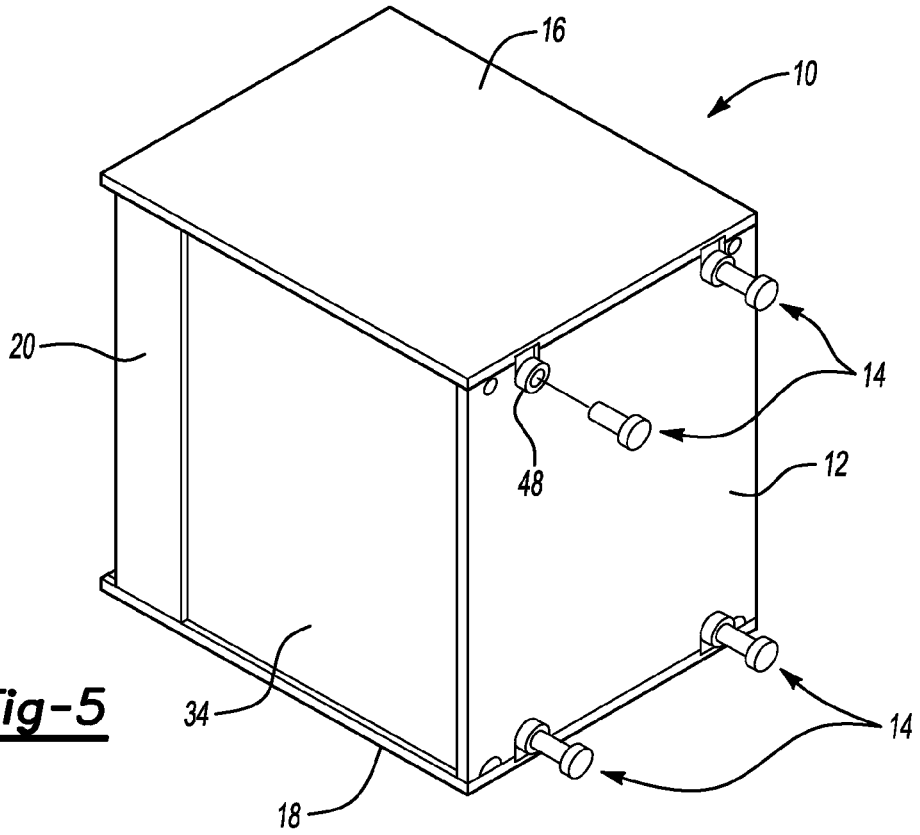
FIG. 5 is a perspective view of the assembly step where leveling legs are assembled to the cabinet.

Referring to FIG. 5, another step in the assembly panel is indicated and includes the steps of assembling the adjusted pull legs 14 to a base 48 that is mounted to the base panel 12. The legs 14 include an adjustable length such that each of the legs on the cabinet can be independently adjustable to accommodate differences in the floor on which the cabinet 10 is installed. A toe kick plate is attached to the legs 14 once a desired level position of the cabinet 10 is obtained.

Figure 6:
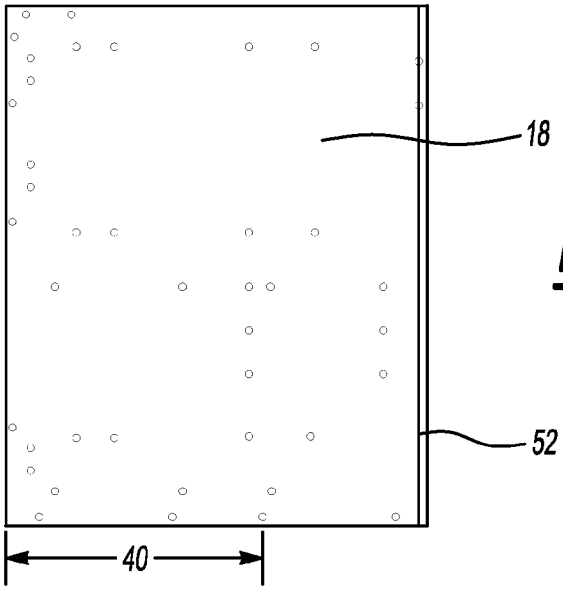
FIG. 6 is a plan view of one panel of the example cabinet.
Figure 7:
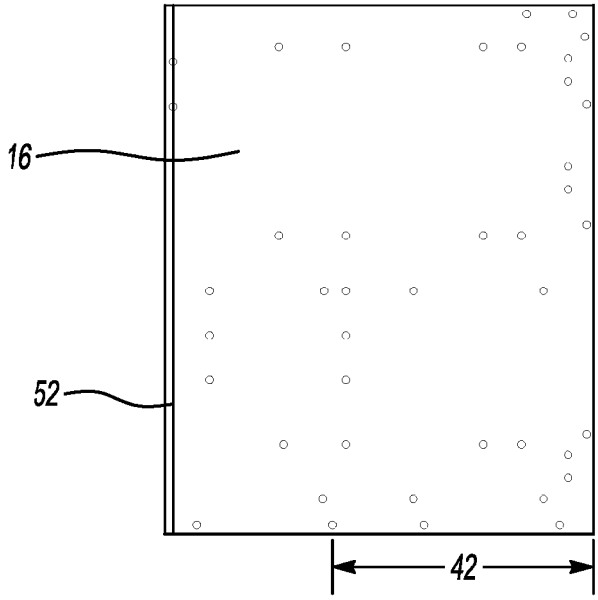
FIG. 7 is a plan view of another panel of the example cabinet.
Figure 8:
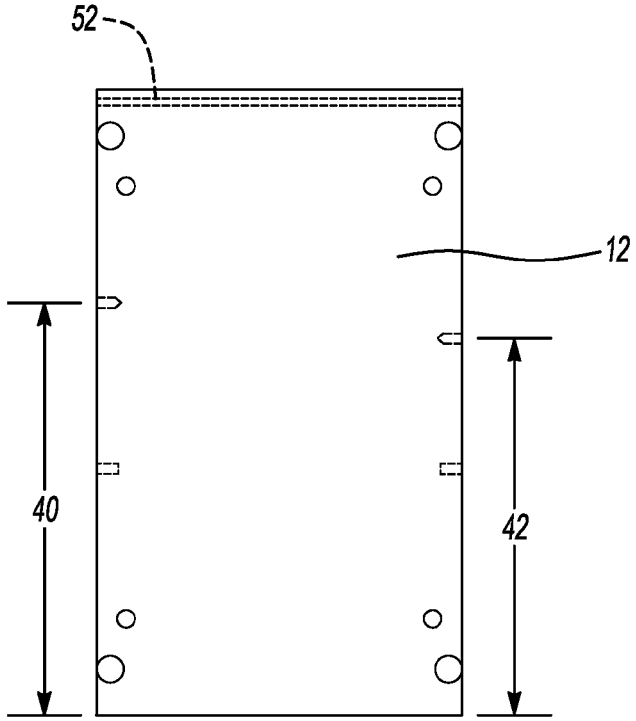
FIG. 8 is a plan view of an example bottom shelf of the example cabinet.

Referring to FIGS. 6, 7 and 8, the first side panel 16, second side panel 18 and base panel 12 are all illustrated. As is indicated, each of the panels 16, 18, 12 includes a plurality of pre-drilled openings. These openings receive fasteners 30, dowel pins and other fastening members as are known. Each of the panels 16, 18, 12 includes openings that correspond with another of the panels 16, 18, 12. At least one of the panels 16, 18, 12, will include a fastener 30 that is already attached. The preassembled fasteners 30 eliminate the need for separate parts bags and reduces problems associated with separate parts. The fasteners 30 are of the type that requires no tools or simple tools to assemble.

The disclosed cabinet assembly 10 includes different dimensions for each of the panels 16, 18, 12. Each of the panels includes one dimension that is unique to that panel mating interface. In the disclosed example, the second side panel 18 includes a dimension 40 from one side to a single opening that corresponds to another dimension 40 on the base panel 12. The second panel 18 therefore can only be assembled to one side of the base panel 12. As the base panel 12 includes fasteners at a unique distance 40, another panel with a different dimension cannot be attached to the base panel 12 because a single fastener will not correspond to an opening and thereby prevent assembly.

The first panel 16 includes a dimension 42 to the same hole. The dimension 42 is different than the dimension 40 and corresponds to another dimension 42 on the panel 12. The dimension 40 and 42 are on opposite sides of the base 12 and correspond to the second panel 18 and the first panel 16.

Not only does the unique dimension 40, 42 prevent assembly of a first panel 16 in the position of the second panel 18; it also prevents reverse assembly of either of the panels 16, 18. Each of the example panels includes a groove 52 that matches up with grooves 52 on the first and second panel 16, 18. The unique dimensions 40, 42 prevent assembly of the side panels in a manner that does not align the grooves 52. The back pane 34 (FIGS. 4 and 5) is not a structural feature and does not attached to the other panels by way of fasteners 30.

The disclosed ready to assemble cabinet 10 includes the plurality of panels that each includes at least one dimension that is unique with respect to other panels forming the cabinet 10 to assure proper assembly. The example kit includes a plurality of fasteners attached to the corresponding panels. At least a couple of the fasteners are spaced apart from each other at a specific distance that is unique for each panel. The specific and unique distances for each of the fasteners that correspond to each of the panels prevent incorrect assembly.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A ready to assemble cabinet kit comprising:

a top panel that defines a top exterior side of a completed cabinet;

a bottom panel that defines a bottom exterior side of a completed cabinet;

at least one front panel that defines a movable exterior closure of a completed cabinet;

a first side panel that defines a first vertical exterior side of a completed cabinet, the first panel including a first plurality of openings for receiving assembly hardware arranged according to a first pattern;

a second side panel that defines a second vertical exterior side of the completed cabinet, the second panel including a second plurality of openings for receiving assembly hardware arranged according to a second pattern that is different than a mirror image of the first pattern for preventing incorrect assembly of the first panel and the second panel; and a plurality of corresponding assembly hardware that is received within at least corresponding ones of the first and second plurality of openings.

2. The cabinet kit as recited in claim 1, wherein the first pattern includes a first distance between at least two openings, and the second pattern includes a second distance between at least two openings that is different than the first distance.

3. The cabinet kit as recited in claim 1, wherein the assembly hardware is assembled into all of the first plurality of openings and the second plurality of openings.

4. The cabinet kit as recited in claim 1, wherein the assembly hardware includes mating locking fasteners.

5. The cabinet kit as recited in claim 1, wherein the assembly hardware includes at least one dowel pin for assembly into each of the first and second patters of the plurality of openings.

6. The cabinet kit as recited in claim 1, including legs attachable to the bottom panel, wherein each of the legs includes a variable height for accommodating varying installation requirements.

7. The cabinet kit as recited in claim 1, including a shelf attachable to each of the first side panel and the second side panel on distal sides, wherein a corresponding hole pattern on each of the distal sides of the shelf are different such that the shelf is attachable in only one orientation between the first and second vertical side panels.

8. A method of fabricating a ready to assembly cabinet kit comprising the steps of:

machining openings in a top panel that defines a top exterior side of a completed cabinet assembly;

machining openings in a back panel that defines a back exterior side of a completed cabinet assembly;

machining a first plurality of openings into a first side panel that corresponds to a first exterior vertical side of a completed cabinet, the first plurality of openings formed to receive a corresponding first plurality of assembly hardware;

machining a second plurality of openings into a second side panel that corresponds to a second exterior vertical side of a completed cabinet, the second plurality of openings formed to receive a corresponding second plurality of assembly hardware, where the second plurality of openings includes at least one dimension that is different than a mirror image of the first plurality of openings in the first side panel; and machining a bottom panel corresponding to a bottom side of a completed cabinet, the bottom side to include a third plurality of openings that corresponds with only the first plurality of openings of the first side panel and a fourth plurality of openings that corresponds with only the second plurality of openings on the second side panel.

9. The method as recited in claim 8, including the step of installing a corresponding one of the plurality of assembly hardware into each corresponding one of the first plurality, second plurality, third plurality, and fourth plurality of openings.

10. The method as recited in claim 9, including installing assembly hardware into each of a corresponding plurality of openings within each of the top panel and back panels.

11. The method as recited in claim 9, including the step of packaging at least the first side panel, the second side panel and the bottom panel in an unassembled state with each of the openings including a corresponding one of the plurality of assembly hardware assembled therein.

* * * * *